United States Patent [19]

De Mendez et al.

[11] Patent Number: 4,717,352

[45] Date of Patent: Jan. 5, 1988

[54] CONNECTION ELEMENT BETWEEN AN ELECTRIC CONNECTOR AND A CONNECTOR CONTACT

[75] Inventors: Michel De Mendez, Montlhery; Raymond Bargain, Sartrouville; Yves Dohan, Paris; Guy Herubel, Marly Le Roi, all of France

[73] Assignee: Souriau & Cie, France

[21] Appl. No.: 839,098

[22] Filed: Mar. 13, 1986

[30] Foreign Application Priority Data

Mar. 19, 1985 [FR] France ..... 85 04041
Jun. 3, 1985 [FR] France ..... 85 08331

[51] Int. Cl.[4] ..... H01R 13/20

[52] U.S. Cl. ..... 439/161; 439/932; 439/842

[58] Field of Search ..... 339/30, 258 R, 259 R, 339/262 R, DIG. 1

[56] References Cited

U.S. PATENT DOCUMENTS

| | | | |
|---|---|---|---|
| 3,906,623 | 9/1975 | Clabburn et al. | 29/628 |
| 3,985,950 | 10/1976 | Maltz | 174/88 C |
| 4,022,519 | 5/1977 | Hill | 339/30 |
| 4,487,465 | 12/1984 | Cherian | 339/30 |
| 4,634,201 | 1/1987 | Kemka | 439/161 |

FOREIGN PATENT DOCUMENTS

| | | |
|---|---|---|
| 0081372 | 6/1983 | European Pat. Off. . |
| 0123376 | 6/1984 | European Pat. Off. . |
| 0112618 | 7/1984 | European Pat. Off. . |
| 1327441 | 8/1973 | United Kingdom . |
| 1579734 | 11/1980 | United Kingdom . |
| 2128039A | 4/1984 | United Kingdom . |

OTHER PUBLICATIONS

French Search Report, FR 85 04 041.
French Search Report FR 85 04 040.
"Shape Memory Effect, Superelasticity and Damping in Cu-Zn-Al Alloys" Report 78R1, Katholieke Universiteit Leuven, Belgium, by L. Delaey et al, Feb. 1, 1978.
French Search Report FR 85 04 042.
French Search Report FR 85 11 088.
IEEE Transactions on Components, Hybrids and Manufacturing Technology, vol. CHMT-3, Jun. 1980, pp. 226-232, IEEE, New York, U.S.
C. J. Evans, "Connector Finishes, Tin in Place of Gold," p. 226.

*Primary Examiner*—Gil Weidenfeld
*Assistant Examiner*—Paula A. Austin
*Attorney, Agent, or Firm*—Stevens, Davis, Miller & Mosher

[57] ABSTRACT

The invention relates to a connection element between an electric connector and a connector contact.

The element comprises a shank intended to receive the electric cable and an active contact part intended to ensure electric connection and mechanical cohesion with the contact. The active part at least is of conductive shape-memory material and is shaped in a manner to be able to tightly adapt to the contact in a first shape-memory state, and to be able to ensure the disengagement and/or engagement of the element in a second shape-memory state.

Application to hermetic connectors and other non-demountable contact connectors.

16 Claims, 11 Drawing Figures

CONNECTION ELEMENT BETWEEN AN ELECTRIC CONNECTOR AND A CONNECTOR CONTACT

BACKGROUND OF THE INVENTION

The present invention relates to a connection element between an electric connector and the rear part of a connector contact. For connecting the contact of a connector to an electric current conductor, it is necessary to provide a system adapted to be able to ensure a fixed contact conductor connection. In a general manner, this system makes up part of the contact, which has behind a form onto which the conductor is connected. The methods of connection are diverse, crimping, brasing, auto-stripping electric soldering or rolled connection, also known as "wrapping", or the like and the shapes of connection are also of geometries varying as a function of these methods.

However, with certain types of connectors, in the case of connectors having non-demountable contacts rigidly fixed in the connector, the majority of the mentioned methods cannot be used. Further, certain methods of connection cannot be used because of the space available for using the connector or because of the conditions of use of it as in the case of hermetic connectors for which, because of congestion or space, the mentioned methods cannot be used.

THE INVENTION

The present invention has the object of remedying these mentioned inconveniences by providing a connection element between a conductor and a connector contact usable without the normal contact methods.

Another object of the present invention is provision of a connection element between an electric conductor and a connector contact able to be used whatever the type of connector, particularly in the case of hermetic connectors.

Another object of the present invention is to provide a connection element between an electric conductor and a connector contact able to be used in any type of connector, particularly in any place, even minimal, which is available for the operation of the connector.

The connection element between an electric conductor and the rear part of a contact of a connector of the invention, comprises a shank intended to receive the electric cable and an active connection part intended to ensure electric connection and mechanical cohesion with the contact, it is remarkable in that the active part at least is of shape-memory conductive material, the active part being shaped in a manner to be able to tightly adapt to the rear part of the contact in a first shape-memory state and to be able to ensure the disengagement and/or the engagement of the element in a second shape-memory state.

THE DRAWINGS

Figure 1A:
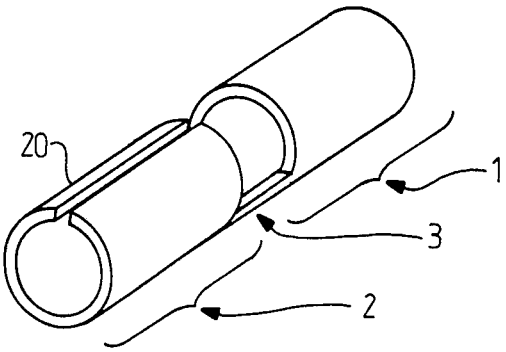
Figure 1B:
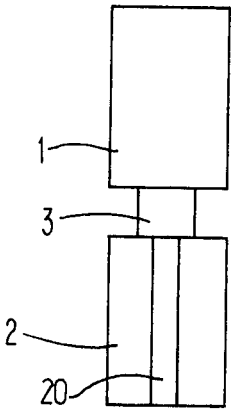
Figure 2:
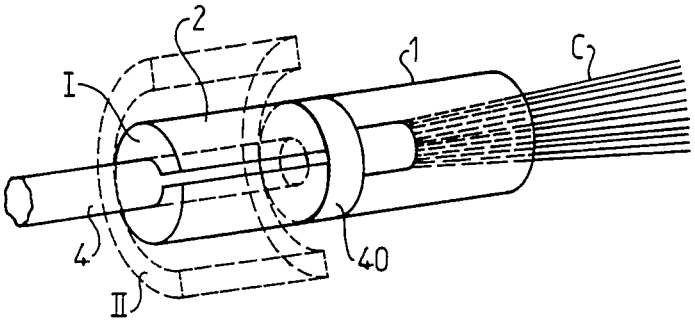
Figure 3A:
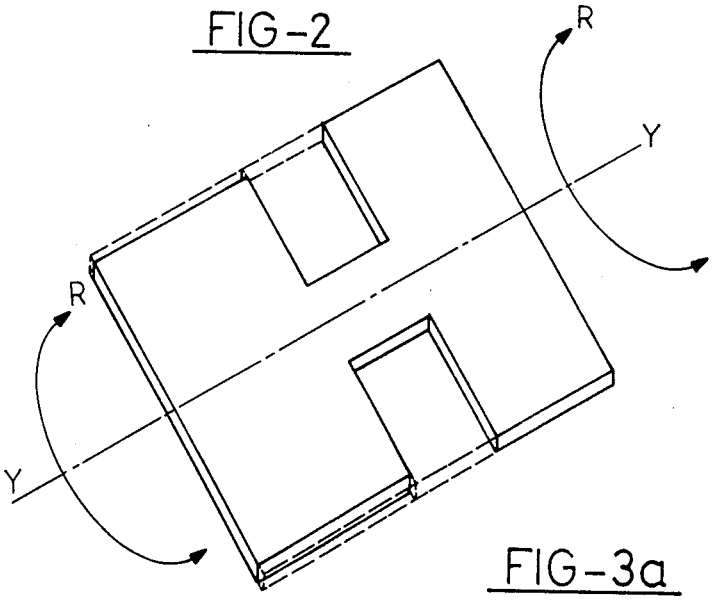
Figure 3B:
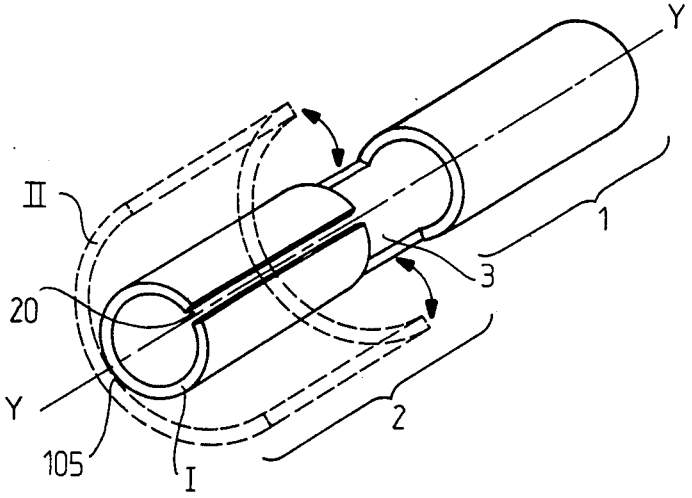
Figure 4A:
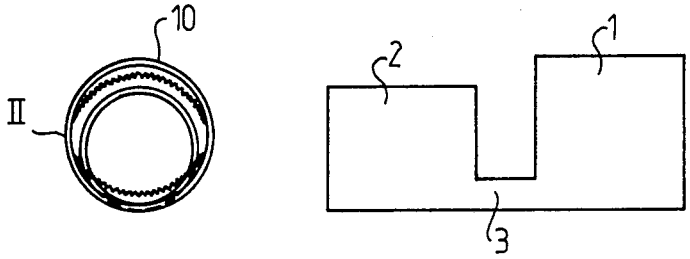
Figure 4B:
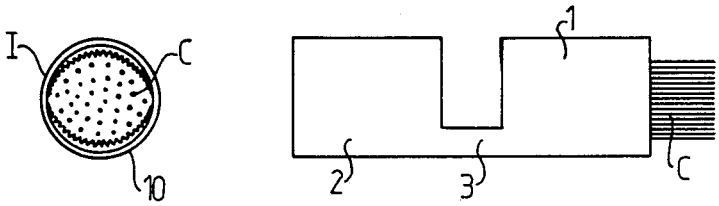
Figure 5A:
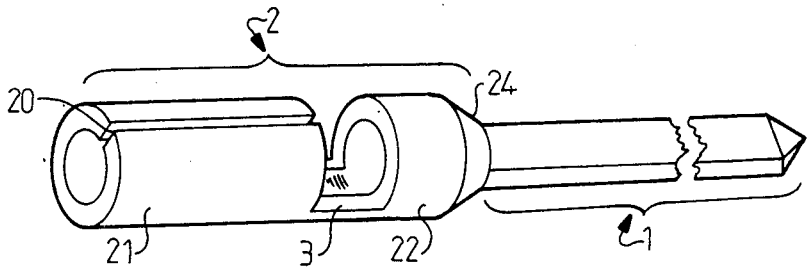
Figure 5B:
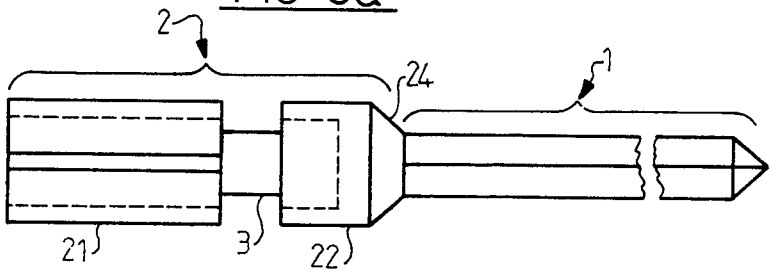
Figure 6A:
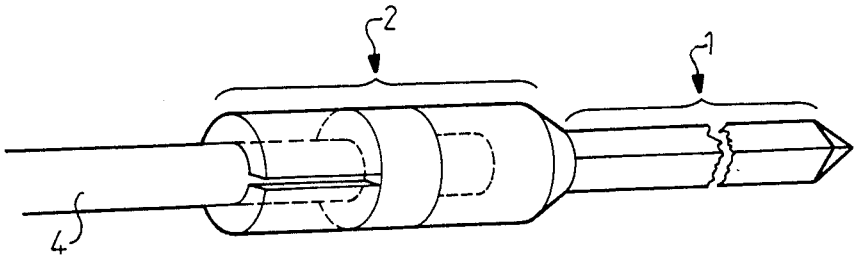
Figure 6B:
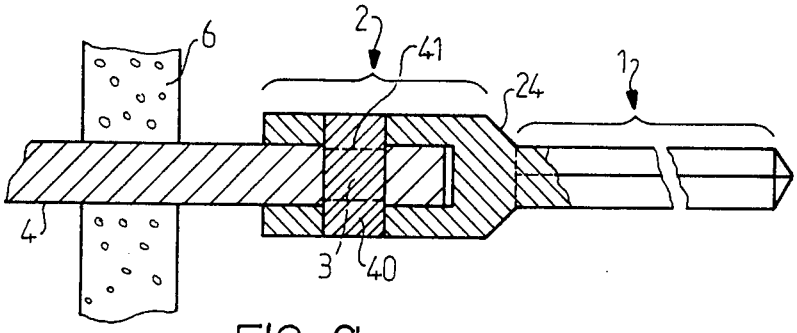

The invention will be better understood on reading the following description and studying the drawings which are not to scale in order to assist their understanding and in which:

FIGS. 1*a* and 1*b* show respectively a perspective view and a plan view of a connection element of the invention, FIG. 2 shows a connection element of the invention, in position on the contact of a connector, FIGS. 3*a* and 3*b* illustrate a method of production of a contact element of the invention, FIGS. 4*a* and 4*b* show a variant of a connection element according to the invention, FIG. 5*a* shows in perspective a connection element according to the invention, FIG. 5*b* shows a plan view of FIG. 5*a*, FIG. 6 shows a connection element according to the invention in position on the rear part of a contact, and FIG. 6*b* shows a longitudinal cross-sectional view of FIG. 6*a*.

EMBODIMENTS OF THE INVENTION

As shown in FIG. 1, the contact element between an electric conductor and the rear part of a connector contact has a shank or connection zone 1, intended to receive the electric cable and an active part 2 called the connection part. By shank or connection zone is in fact intended any mechanical piece, cylindrical or not able to receive the electric cable for ensuring electric contact and mechanical cohesion with this. The active part 2 is intended to ensure electric connection and mechanical cohesion with the rear part of the contact of the connector. In FIGS. 1*a* and 1*b*, the connection element is shown in perspective at 1*a* and in plan view at 1*b*.

The active part 2 at least is made of shape-memory conductive material. For example the active part 2 can, in a non-limitative manner, be built up by known methods such as brasing onto the shank which is itself made of shape-memory or not conductive material. The active part 2 is shaped in a manner to be able to tightly adapt to the rear part of the contact of the connector, in a first shape-memory state and to be able to ensure the disengagement and/or engagement of the connection element in a second shape-memory state.

The mentioned shape-memory states will be described in detail in the following description. The first shape-memory state, during which electric contact is ensured, is stable at ambient temperature. Similarly, the first shape-memory state is also stable at low temperature. That is to say the lowest temperatures of operating specifications for the corresponding connector. By way of example, the first shape-memory state is stable to a temperature of −65° C.

The structure of the connection element of the invention, in its first shape-memory state I and in its second shape-memory state II will be described in connection with FIG. 2.

As shown in this Figure, the active part 2 and the shank 1 can each be constituted by a substantially tubular element, connected by a common intermediary part 3. The active part 2 has a slit 20 arranged throughout its length. By way of non-limitative example, this slit 20 can be arranged along a generatrix of the active part 2 or in any particular configuration, such as a helix or the like. Further, the tubular element constituting the active part can have a conical cross-section. The separation between the shank 1 and the active part 2 at the common intermediary part 3 appears as a slot or a transverse opening arranged substantially in the middle part of the connection element, as is also clearly shown in FIGS. 1*a* and 1*b*. Further, preferably, the connection element can be completely made of shape-memory material. In FIG. 2, the first shape-memory state I is shown, the active part 2 of the connection element being tightly adapted to the contact 4 of the connector, then in its second shape-memory state, referenced II, the active part 2 is shown spread out in contrast in dashed lines. In FIG. 2, the electric cable fixed to the shank 1 is referenced C.

The shape-memory states I and II can, according to the invention, be either non-reversible or reversible. Preferably, the active part 2 will have reversible first I and second II shape-memory states. The cable C having been connected to the shank 1, for example by conventional means, that is to say by brasing, crimping or the like, the bringing of the active part 2 into its shape-memory state II permits opening into the spread-out position of this active part and the suitable positioning of the contact element, with respect to the contact 4 of the connector, for the operation of connection. The bringing to state II, that is to say the spread-out position of the active part 2, can be carried out by the simple lowering of the temperature of this active part, or the entire connection element, below the temperature of transition of the shape-memory material, the temperature Ms, the temperature Ms being defined as the temperature at which the martensitic phase of the shape-memory material in question begins to be formed on its own. Of course any lowering of temperature to a lower temperature, such as particularly the temperature Mf defined as the temperature at which the entire shape-memory material is transformed into the martensitic phase, will not depart from the scope of the present invention. The required lowering of temperature can be caused by any source of cold normally available in an industrial environment. The connection element in its shape state II being suitably arranged with respect to the contact 4 of the connector, this is held in its relative position with respect to the mentioned contact 4, and submitted to a reheating by simple removal of the source of cold. By suitable arranging of the connection element with respect to the contact 4, is intended for example in the case where the contact 4 is provided with a collar 40, the positioning of the active part 2 and of the shank 1 such that the collar 40 engages in the transverse slot or opening existing between the shank 1 and the active part 2 at the common part 3. The normal heating of the connection element and principally of the active part 2 has the effect of bringing the mentioned active part into the memory-state I, as shown in FIG. 2, thus, at the temperature of use of the connector, the electric contact between the connection element and the contact 4 of the connector is ensured particularly at the active part 2 of the connection element, which further as a result of securing of the contact 4 in this position, ensures also mechanical cohesion of the assembly.

In the case where the shape-memory states I and II are reversible, it is in addition possible to obtain the opening into spread-out position of the active part 2, by simple lowering of the temperature as previously defined, in order to permit if necessary unfixing of the connection element and of the contact 4 with a zero or negligible force of connection or disconnection. It will also be understood that as a result of use of the mentioned shapes, the successive connection and disconnection of a connection element to a contact element 4 of the connector can thus be effected in a repetitive manner practically without wear.

In the case where the active part is provided with non-reversible shape-memory effect, the closing of the active part on the contact 4, at the temperature of use, that is to say in fact the passage of the active part 2 from its spread-out position II, obtained for example also by lowering of the temperature, to the position I after reheating is then final.

Examples of shape-memory materials, able to be used for the operation of the present invention, will now be given. Preferably, the shape-memory material is chosen amongst the group of compositions nickel-titanium, nickel-aluminium, nickel-titanium-iron, copper-zinc-alumium, copper-aluminium-nickel in the form of intermetallic compositions or in alloyed form. By way of non-limitative example, a connection element according to the present invention has been made from an alloy having substantially 4% of aluminium, 28% of zinc, the balance percentage being of copper, the percentages indicated being atomic percentages. The temperature of transition Ms obtained with this type of alloy is in the region of −80° C.

An example of production of a connection element according to the invention will now be described by means of FIGS. 3*a* and 3*b*.

According to these mentioned Figures, the connection element can be obtained from a sheet of mentioned alloy, stamped as shown in FIG. 3*a*, substantially in the shape of an H. The stamped sheet is then submitted to a mechanical treatment by rolling, in a manner to form the shank 1 and the active part 2 substantially in tubular form. In FIG. 3*a*, the treatment by rolling is referenced R and it will be noted that with respect to the axis of longitudinal symmetry YY of the sheet, one of the branches of the H is smaller than the other branch, in a manner to form at the active part 2 the slot 20 after rolling as is in addition shown in FIG. 3*b*.

As shown in FIG. 3*b*, an example of treatment of a connection element according to the invention will now be described with a view of obtaining the first I and second II mentioned reversible shape-memory states.

After the operations have been carried out, such as shown in FIG. 3*a*, the connection element of the invention has been formed to the final shapes and dimensions constituting the first shape-memory state I as shown in FIG. 3*b*. The connection element is then submitted to a thermal treatment able to bring it into an austenitic crystallographic phase and next to a recooling to a temperature in the region of ambient temperature. By recooling, is intended, a recooling such as obtained by means of a treatment of the quenching type for example, in a manner to avoid the appearance of a parasitic crystallographic phase.

The connection element of the invention is then submitted in at least one deformation zone of it, principally the active part 2 of it, to a process called education. In FIG. 3*b*, the deformation is designated 105 and is shown positioned in the region of the intersection of the diametral plane of longitudinal symmetry of the active part 2, containing the longitudinal axis of symmetry YY and of the active part 2.

The process of education consists of imposing repetitively on the active part 2, a mechanical stress, such that the active part 2 is, in this deformation zone 105, deformed in a manner to bring the ears constituting the active part 2 into a shape position close to the second shape-memory state II, and of submitting the entire element, with the stress being maintained, to a lowering of temperature able to bring the active part 2 or the entire connection element into a martensitic phase state. Of course, the lowering of temperature can be carried out by means of any source of cold applied either to the entire connection element or solely to the deformation zone 105. The mechanical stress can be applied by means of a tool permitting a sufficient spacing of the ears of the mentioned active part to obtain the desired shape-memory position. After removal of the mechanical stress, the connection element is submitted to progressive reheating to ambient temperature. It then takes up again its stable shape state or first shape-memory state. The repetition of the cycle imposed for the education, as previously defined, must be sufficient to obtain a good degree of reproduceability of transitions between the first and the second subsequent shape-memory state, solely by lowering of the temperature followed by successive elevation of the temperature for the return to the initial position or shape-memory state.

A variant of the process of education will be given by way of non-limitative example in connection with FIG. 3*b*.

According to this variant, the process consists of imposing in the absence of deformation of the object, constituted by the connection element formed in its initial state, a thermal stress consisting of a variation of temperature able to bring the contact element or at least the active part of it, into a martensitic crystallographic phase. Then, the active part being in the mentioned state, a mechanical stress, such that the active part 2 is deformed, is applied in a manner to bring this active part 2 into a position or shape state close to the second shape-memory state II. Lowering of the temperature and application of the mechanical stress can be carried out with the aid of means already mentioned, the application of the mechanical stress being able to be carried out in a liquid nitrogen bath when the source of cold is constituted by such a bath. Next, a shape-memory state called intermediary, close to the initial shape state of the active part 2, is then defined and imposed on it. The imposition of the intermediary shape to the active part 2 is carried out by the imposition of limits of subsequent change of shape of it to corresponding limits of the intermediary shape state. By intermediary shape state close to the initial shape state is intended a shape state in which the return to the initial state has been obtained or to a shape close to this initial state.

The definition and imposition of limits of change of shape of the active part 2 can be carried out by means of a mandrel introduced into the active part 2, the mandrel having external dimensions corresponding to the dimensions of the intermediary shape state. The active part 2 in martensitic state to which the limits of change of shape have been imposed is then submitted to a progressive reheating to the ambient temperature for returning it into an austenitic type crystallographic phase state. As a result of maintaining the active part 2 at the intermediary shape state and of the reheating, internal stresses permitting the definition of the intermediary shape state as the first shape-memory state I are then introduced into the active part 2. The above method for the production of a connection element of the invention by stamping and rolling is not limitative. Of course, connection elements of substantially analogous shape, can be obtained from shape-memory materials, delivered in the form of rod, cylindrical ingot or the like by milling, turning, piercing and any conventional machining operation.

Further, use of the reversible or not shape-memory effect is of course not limited to only the active part of the connection element. In fact, the shank 1 itself can have, as shown in FIGS. 4*a* and 4*b*, first I and second II shape-memory states. The shank 1 is for example formed in a manner to be able to adapt tightly to a cable C in its first shape-memory state, and in a manner to permit the engagement and/or disengagement of the cable C in its second shape-memory state. In FIG. 4*a* showing the second shape-memory state II of the shank 1, this is shown in splaid position, permitting an easy introduction of the cable C into the shank, in order to permit corresponding electric connection. The splaid position can be obtained by lowering of the temperature of the shank 1, below the temperature of transition Ms of the constituent alloy of the connection element. In FIG. 4*a*, will be further noted the presence on the internal face of the shank 1 of roughness designated 10, which in the shape-memory position II, that is to say in splaid position, does not of course oppose the introduction of the cable C into the shank. The cable being introduced, the shank 1 is submitted to a reheating to bring it to its shape-memory position I, as shown in FIG. 4*b*. The shape-memory position I is a retracted position with dimensions substantially analogous to that of the active part 2 in the same position I. The shape-memory position I permits mechanical fixing of the cable C and corresponding electric connection, on account of the tightening thus achieved. The previously mentioned roughness 10 has then the role of ensuring a better electric contact with the cable as well as a better mechanical cohesion. This type of connection can of course be achieved in the case of connection by displacement of insulant.

In this case, such roughness perforates the insulant and ensures electric contact with the cable as well as mechanical retention.

A connection has thus been described, in which the above mechanical structures are not limitative. In fact the transverse slot or opening, situated at the common part 3, can obviously be replaced or filled in by any rib or the like situated substantially on the directrix line of the active part, and intended to be engaged in a corresponding slot or opening of the contact 4, in order to ensure electric contact and corresponding mechanical cohesion.

Further, the connection element of the invention is remarkable in that it permits ensuring electric connection with the contact of the connector, without any filling metal and without use of cumbersome tools. The passage from one shape-memory state to the other shape-memory state, the splaid state, can be carried out outside the connector on mounting of the connection element, the temperature at which this is brought about being chosen much lower than the temperature of transition of the alloy constituting the connection element and the thermal intertia of the connection element being sufficient to permit the holding of the splaid shape-memory state. The positioning of the connection element on the contact of the conductor can then be carried out without difficulty before reheating and return to the initial shape-memory state. In the case of disconnection, it is sufficient to bring for example the entire connector, or merely the connection to be disconnected, to a temperature lower than the transition temperature of the alloy.

Further, a connection element of the invention can have at least at the active part, a conductive protective covering consisting of a deposit of gold, of silver, of palladium alloy, or of tin lead. This latter covering can in fact be used for enlarging the usual field of use, since there is practically no problem of friction nor of wear at the connection element.

According to an advantageous variant, the connection element previously described can be used to permit a method of connection to an electric conductor cable, other than direct contact or the displacement of insulant, a technique such as the rolled connection so-called "wrapping".

In accordance with a method of production of this variant, the active part of the element having the above described essential characteristics, the shank is itself constituted by a rod called a wrapper, that is to say a stem permitting a rolled connection.

According to another variant, the shank itself is of a shape-memory conductive material, the entire connection element of the invention being of such material.

According to FIG. 5*a*, the connection element between an electric conductor and the rear part of a contact of the connector, in accordance with the invention, has a shank designated 1 constituted by a stem permitting connection of the conductor by the rolled connection method.

The rolled connection is the subject of a definition in French standard NF C93021. The rolled connection has been defined in this standard, as involving a wire, a terminal and a rolling tool. This connection ensures without soldering a stable mechanical and electrical connection between a massive round conductor wire and an appropriate terminal with projecting ridges by helical rolling under a certain tension of a certain size of the conductor on the terminal. The tension in the rolled conductor renders tight by pressure the contact surfaces of the conductor and of the terminal, thus avoiding corrosion of these zones which will cause a variation of contact resistance.

In accordance with the object of the invention, the active part of the contact element is constituted by a shape-memory conductive material. Amongst the shape-memory materials used, one can mention all the materials set out above and particularly the compositions nickel-titanium, nickel-aluminium, nickel-titanium-iron, copper-zinc-aluminium, copper-aluminium-nickel, in the form of intermetallic compositions or in alloyed form. The shank 1 is constituted by an element of substantially square cross-section and having sides with sharp angles in order to permit connection according to the specifications of the mentioned standard.

Of course, the entire connection element of the invention, can be entirely of a shape-memory material. In this case, the connection element of the invention can be obtained by methods of machining such as previously mentioned, particularly from a ribbon of material by stamping and rolling. Of course the active part 2 is submitted to a process of education according to the corresponding characteristics of the active part such as previously described.

As is shown in FIGS. 5*a*, 5*b* and further in FIGS. 6*a*, 6*b*, the active part substantially comprises a first substantially cylindrical tubular part 21 having a slot 20 throughout the length of one of its generatrices. Further, the active part 2 comprises a second substantially tubular and cylindrical part mechanically connected to the first part 21 by an intermediary element 3.

The second part 22 is further adapted in order to ensure mechanical connection with the shank 1 permitting rolled connections to be made. For this, the second part 22 is provided at its end opposite from the intermediate element with a truncoconical termination 24 at the beginning of the stem 1. The stem is then connected at the trunco-conical termination 24 and fixed to it by means of solder at points for example. According to a variant, the stem 1 and the trunco-conical termination can be made as one and the same element, the trunco-conical termination then being connected by soldering at points to the second tubular part 22.

In FIG. 6*a* has been shown a connection element of the invention placed in position around the contact 4. For placing the connection element of the invention around the contact 4, the connection element, or the active part of it, is first cooled to a temperature lower than the transition temperature of the constituent alloy of the element or of the active part. The thermal stress thus created at the active part 2 of the connection element, has the effect of bringing this to the shape-memory state II, that is to say to spread-out position. The active part 2 being placed on the contact and particularly at the level of the boss 40 arranged for this on the contact 4, the reheating of the connection element and of the active part 2 permits placing and closing of the active part 2 in accordance with FIG. 6*a* on the contact 4. Of course, the cross-sectional shape of the contact 4 at the active part 2 can further be adapted in order to improve the quality of the connection and in order to avoid any rotation of the connection element with respect to the longitudinal axis of the contact. Further, the boss 40 can be provided with a notch or housing into which the intermediary part 3 connecting in fact the first tubular part 21 to the second tubular part 22 is engaged. It is thus possible to ensure prevention of rotation of the connection element with respect to the longitudinal axis of the contact. In FIG. 6*b*, the housing 41 arranged at the boss 40 and in which the intermediary part 3 is engaged has been shown.

The connection element thus described is particularly adapted for use on hermetic contact points or the like as shown in FIG. 6*b*. In this type of connector or point, the usual contact methods, and particularly the connection by rolled connection made directly on the contact cannot be carried out because of the small volume available for making this type of contact by means of appropriate tools and in particular because of the smallness of the available space around each contact in the region of the insulating wall 6 of the rear part of the connector.

Further, alloys capable of good glass metal contact in order to ensure good hermetic imperviousness do not have, after passage through an oven at 750° C. 800° C. for example for sealing, sufficient mechanical characteristics to resist torsion in rolling of the conductor wire which further warrants interest in a connected piece or connection element such as defined in the present application.

We claim:

1. A connection element between an electric conductor and the rear part of a connector contact comprising:

a shank intended to receive the electric conductor; and an active connection part intended to ensure electric connection and mechanical cohesion with the contact;

said active part being of conductive, homogeneous shape-memory material;

said active part being shaped in a manner to be able to adapt tightly to the rear part of the contact in a first shape-memory state and able to ensure the zero insertion force disengagement and/or the engagement of said element in a second shape-memory state said first and second shape-memory state of said active part being reversible.

2. A connection element according to claim 1, wherein the first shape-memory state, in which electric contact is ensured, is stable at ambient temperature.

3. A connection element according to claim 1, wherein the first shape-memory state, in which electric connection is ensured, is stable at low temperature.

4. A connection element according to claim 1, said connection element being entirely made up of shape-memory material.

5. A connection element according to claim 1, wherein said first and second shape-memory states of said active part are non-reversible.

6. A connection element according to claim 1, wherein said shape-memory material is chosen amongst the group of compositions nickel-titanium, nickel-aluminium, nickel-titanium-iron, copper-zinc-aluminium, copper-aluminium-nickel in intermetallic composition form or in alloyed form.

7. A connection element according to claim 1, wherein said active part at least has a protective conductive covering.

8. A connection element according to claim 1, wherein said active part and said shank each comprise a substantially tubular element said tubular elements being connected by a common intermediary part, said active part having a slot extending substantially throughout the length of the active part.

9. A connection element according to claim 8, wherein said active part has a rib substantially at one of its directrix lines.

10. A connection element according to claim 1, wherein said shank comprises a stem permitting the connection of the conductor by the rolled connection or wrapping method.

11. A connection element according to claim 10, wherein said stem comprises a substantially square section element, said stem having sharp angled edges.

12. A connection element according to claim 10, said connection element being entirely of a shape-memory material.

13. A connection element according to claim 10, wherein said active part substantially comprises:

a first substantially cylindrical tubular part having a slot throughout the length on one of its generatrices and a second substantially tubular cylindrical part mechanically connected to said first part by an intermediary element, said second part being provided at its end opposite from the intermediary elements with a trunco-conical termination at the beginning of said stem.

14. A connection element between an electric conductor and the rear part of a connector contact, comprising:

a shank intended to receive the electric conductor; and an active connection part intended to ensure electric connection and mechanical cohesion with the contact;

said active part at least being of conductive shape-memory material;

said active part being shaped in a manner to be able to adapt tighty to the rear part of the contact in a first shape memory state and able to ensure the disengagement and/or the engagement of said element in a second memory state, wherein said shank itself has and first and second shape-memory states, said shank being shaped in a manner to be able to rightly adapt to said cable in its first shape-memory state and in order to permit the engagement and/or disengagement of the cable in its second shape-memory state.

15. A connection element according to claim 14, wherein said shank has roughness on its inside face.

16. A connection element between an electric conductor and the rear part of a connector contact, comprising:

a shank intended to receive the electric conductor;

and an active connection part intended to ensure electric connection and mechanical cohesion with the contact;

said active part is of a conductive shape-memory material;

said active part being shaped in a manner to be able to adapt tightly to the rear part of the contact in a first shape memory state and able to ensure the disengagement and/or the engagement of said element in a second memory state, said shank permitting the connection of the conductor by the rolled connection or wrapping method, and said stem is of a conductive alloy connected by soldering to said active part.

* * * * *